United States Patent [19]

Robillard

[11] 3,964,911

[45] June 22, 1976

[54] PHOTOGRAPHIC REPRODUCTION PROCESSES USING DIAZONIUM SALTS AND SUBSTITUTED SPIRO[BENZOPYRANE]

[75] Inventor: Jean Jules Achille Robillard, Ferney Voltaire, France

[73] Assignee: La Cellophane, Paris, France

[22] Filed: Dec. 18, 1973

[21] Appl. No.: 425,866

[30] Foreign Application Priority Data

Dec. 22, 1972 France ..... 72.27090

[52] U.S. Cl. ..... 96/49; 96/48 R; 96/48 HD; 96/90 PC; 96/91 R

[51] Int. Cl.[2] ..... G03C 5/18; G03C 5/34; G03C 5/24

[58] Field of Search ..... 96/48 R, 48 HD, 49, 96/90 PC, 90 R, 91 R

[56] References Cited

UNITED STATES PATENTS

| | | | |
|---|---|---|---|
| 1,997,507 | 4/1935 | Akintieusky | 96/49 |
| 2,083,285 | 6/1937 | Alink | 96/49 |
| 2,692,826 | 10/1954 | Neugebauer et al. | 96/49 X |
| 3,099,558 | 7/1963 | Leuines | 96/49 X |
| 3,212,898 | 10/1965 | Cerreta | 96/90 PC |
| 3,282,693 | 11/1966 | Sagura et al. | 96/49 |
| 3,451,338 | 6/1969 | Baum | 96/48 HD X |
| 3,730,734 | 5/1973 | Delzenne | 96/90 PC |
| 3,754,922 | 8/1973 | Yoshida | 96/49 |
| 3,765,894 | 10/1973 | Mellow | 96/49 X |
| 3,793,033 | 2/1974 | Mukherjee | 96/115 R |
| 3,804,628 | 4/1974 | Osada et al. | 96/90 PC |

FOREIGN PATENTS OR APPLICATIONS

| | | | |
|---|---|---|---|
| 1,154,716 | 6/1969 | United Kingdom | 96/75 |

OTHER PUBLICATIONS

Shinozaki et al., "Unconventional Photographic Systems", SPSE Symposium, 10/1964, p. 142.

*Primary Examiner*—Charles L. Bowers, Jr.
*Attorney, Agent, or Firm*—Sherman & Shalloway

[57] ABSTRACT

Photosensitive compositions which include a homogeneous mixture of a. at least one diazonium salt which is photodecomposable into phenol;
b. at least one spiropyran compound which is photodecomposable into mercocyanine; and optionally
c. a material which is normally solid at ambient temperatures and has a melting point no higher than about 150°C and which when in the molten state is a solvent for the phenol and merocyanine compounds from (a) and (b), above.

The merocyanine and phenol form colored complexes when reacted in the molten or dissolved state.

The photosensitive compositions of the present invention can be used for preparing reproductions of original transparencies containing image areas and non-image transparent areas as positives or negatives thereof and in colors ranging from blue-black, blue, green, red, orange, brown and colors in between. In the formation of positive images, advantage is taken of the reversibility of the photochemical decomposition of the spiropyran compound into the merocyanine compound.

9 Claims, 2 Drawing Figures

PHOTOGRAPHIC REPRODUCTION PROCESSES USING DIAZONIUM SALTS AND SUBSTITUTED SPIRO[BENZOPYRANE]

BACKGROUND OF THE INVENTION

1. Field of Invention

The present invention relates to novel photosensitive compounds and novel photosensitive compositions based thereon as well as to novel photographic processes employing these compositions and more specifically to high-resolution photographic reproduction processes not requiring wet development.

2. Discussion of the Prior Art

Photographic reproduction processes using silver halide emulsions are well known and widely used for such purposes as reproduction of documents, e.g. microfilms. However, in addition to requiring a wet chemical development process, i.e. liquid developing solutions, silver halide emulsion type photographic processes have the additional disadvantage of graininess in the developed print and therefore are subject to only a limited resolution power.

Electrophotographic processes are also disadvantageous since they only have a low sensitivity, introduce graininess in the developed image, and require for development, addition of toner materials in the form of powders or liquid.

Thermographic reproduction processes are also well known in the prior art but are subject to even lower sensitivities than electrophotographic processes. And, although the emulsions typically used in thermographic reproduction are not grain emulsions, the use of infrared exposure during the reproduction process results in heat diffusion and deterioration of the resolution power of the emulsion. Moreover, thermographic processes have the additional drawback of not being able to reproduce all colors.

Diazo-type printing processes have been used for many years and have been used in several forms, most notable of which are the negative diazo-type processes and the positive diazo-type processes. Exemplary of the former process is the image-wise exposure of a diazo film layer containing a light-sensitive diazonium compound and a mercurous salt. This process results in grainless silver images of high resolving power and requires physical development in which exposure requires only a far smaller quantity of light energy than several other diazo-type processes. The negative type processes have not, however, become commercially successful.

The positive diazo type processes have become increasingly popular due to their high contrast and the short and simple after treatments required to obtain direct positive copies which are particularly adaptable for such uses as the reproduction of line originals such as tracings and in preparation of maps and similar sketches. Typical of the positive diazo-type processes are the two component or "dry" treatments in which a suitable substrate is coated with a light-sensitive diazonium compound and a coupler compound, usually in the presence of a stabilizing acid to prevent premature coupling; after exposure to light through a transparency or the original work, development takes place by contact with an alkaline material, generally anhydrous ammonia. In the semi-dry process, the substrate only contains the photosensitive diazonium compound; after image-wise exposure to light, the substrate is developed by contact with an alkaline developing solution which contains the coupler compound. The third most widely used positive diazo-type process is the heat developable process in which the diazonium compound and the coupler compound are again combined on the substrate in an acid medium containing a base releasing agent which, after the substrate is image-wide exposed to a light source, a heat treatment is administered which results in the production of an alkaline environment which allows the coupler compound and diazonium compound to react and form the dye image.

Each of the different positive processes, however, have been subject to various drawbacks. For example, the dry processes are subject to the problem that with most diazonium compounds and couplers, the waterfastness of the prints obtained is unsatisfactory for many purposes because of the problems in storage of the finished product and the inability to wash the finished product. Moreover, in the production of red or reddish brown prints, the most typically used couplers, amides of 3,5-dihydroxy benzoic acid of the thiazole or selenazole derivatives of these amides only exhibit slight water solubility and makes the use of these compounds difficult. Also, the emulsions used in the heat developable processes remain stable for only relatively short periods.

Some of the foregoing drawbacks have been eliminated in a dry, heat development process using heat sensitive compositions formed with a base of known spiropyrans (as disclosed for example, in J. H. Day, Chem. Rev., 63, 65 (1963) which will decompose upon the application of heat into merocyanines (e.g. merocyanine of 6′chloro-8′-methoxy-benzoindolino pyrylospirane) and phenols which will, when in the molten or dissolved state, react with each other to produce a colored complex. However, because photographic processes based on these spiropyrans require a local heating of the heat-sensitive composition in order to obtain a colored image or line, their use is very complex. In practice, their use is limited to the field of graphic recordings, for example, in recording apparatus using a hot stylus or the like as a means of local heating.

SUMMARY OF THE INVENTION

It has now been discovered that the above disadvantages and problems inherent in conventional photographic developing processes can be eliminated by the use of photosensitive photographic compositions which include a homogeneous mixture of a. at least one diazonium salt which is photodecomposable into phenol, e.g., ArOH wherein Ar is an aromatic radical, b. at least one spiropyran compound which is photodecomposable into merocyanine; and optionally c. a material which is normally solid at ambient temperatures and has a melting point no higher than about 150°C and which when in the molten state is a solvent for the phenol and merocyanine compounds from (a) and (b), above.

These novel photosensitive compositions can be advantageously employed in the development of positive or negative images of an image containing original in a dry development photographic process.

The novel photosensitive compositions of the present invention have very high resolution, are capable of dry development, have a greater stability than diazotherm compositions and have superior contrast and are capable of being used in a wider spectral range, including the visible.

While any spiropyran compound which forms a merocyanine compound upon exposure to actinic radiation can be used in the photographic composition and photographic processes of the present invention, particularly suitable are indolyl-2-spiro(benzo-1-pyrane) and benzothiazole-2-spiro(benzo-1-pyrane) compounds which will be defined in greater detail below. Also particularly useful for the photographic compositions and processes of the present invention are the indoline spiropyrans described in Swiss Pat. No. 444,197 and No. 406,257.

As previously indicated, the novel photographic compositions of the present invention can be used in dry development photographic processes for producing either negative or positive images.

According to one embodiment of the present invention, a process for developing a negative image of an original containing image areas and non-image transparent areas includes placing the original over any suitable base layer carrying a layer of the photosensitive photographic composition of the present invention which includes a homogeneous mixture of at least one diazonium salt, photodecomposable into phenol (e.g. phenol, naphthol and the like) and at least one spiropyran compound photodecomposable into a merocyanine compound (e.g. merocyanine of 2,2'-spiro[3-methyl-6-nitro-8-methoxy-2H-[1]-benzopyran-3'-isopropyl-benzothiazoline]) and optionally a normally solid material having a melting point lower than about 150°C and which is a solvent for both of the above decomposition products (i.e. phenol and merocyanine) when it is in the molten state and subjecting the photosensitive layer to imagewise exposure of actinic radiation whose emission spectrum encompasses the absorption bands of the diazonium compound and the spiropyran compound and thereby produces in the exposed areas of the photosensitive layer, corresponding to the non-image transparent areas of the original, a phenol and a merocyanine compound. Thereafter, the photosensitive layer is heated until both of the phenol and merocyanine are completely melted or dissolved. This condition is then maintained for sufficient time to allow the phenol and merocyanine to react and form a colored complex in the exposed areas. A negative image of the original thereby results.

When the low melting, normally solid material is incorporated in the photosensitive layer, the photosensitive layer after exposure need only be heated until the normally solid material has melted and has dissolved both the phenol and the merocyanine compound whereupon the colored complex can form in solution.

As a further alternative embodiment of the process and compositions of the present invention, spiropyrans yielding merocyanine of a low melting point, i.e. about 100°C or less, can be used to act as a solvent for the phenol of a higher melting point so that the complexing reaction can occur. It is also within the scope of the present invention to use a diazonium salt which will photochemically decompose into a phenol having a relatively low melting point which can act as a solvent for the merocyanine compound.

According to another preferred embodiment of the present invention, a positive image of an original containing image areas and non-image transparent areas is dry developed by first subjecting any suitable base layer carrying a layer of the photosensitive compositions of the present invention (which may or may not include the low melting normally solid material and which may include either high or low melting spiropyrans) to actinic radiation whose emission spectrum encompasses both the absorption band of the diazonium compound and the spiropyran compound to thereby produce by photochemical decomposition or rearrangement a phenol and a merocyanine. The original is next placed over the photosensitive layer which is then subjected to image-wise exposure of actinic radiation, preferably visible radiation, whose emission spectrum encompasses the absorption band of the merocyanine to thereby reconvert the merocyanine into the spiropyran in the re-exposed areas of the photosensitive layer, corresponding to the non-image tranparent areas of the original. Thereafter, the photosensitive layer is heated until both the phenol and the remaining merocyanine (corresponding to the "unexposed" image areas) are melted or dissolved and allowed to react to form a colored complex of the phenol and merocyanine in the "unexposed" areas to thereby produce a positive image of the original.

DETAILED DESCRIPTION OF THE INVENTION

Figure 1:
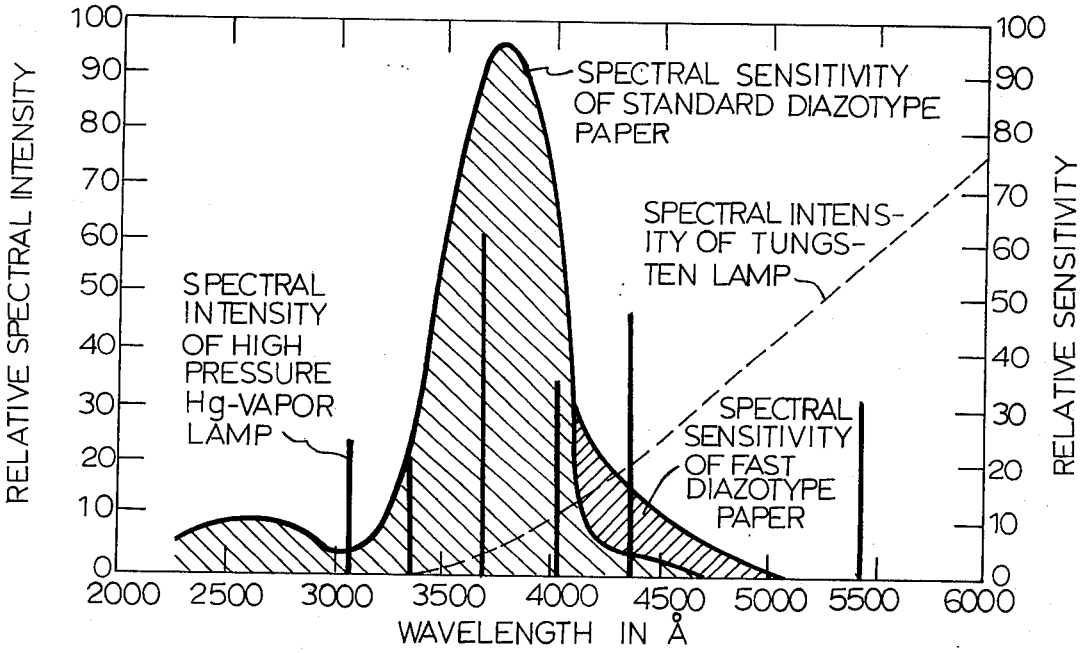

The photographic, photosensitive compositions of the present invention include at least a. a diazonium compound which is photochemically decomposable into a phenol according to the well known reaction:

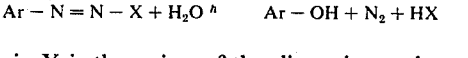

$$Ar-N=N-X + H_2O \xrightarrow{h} Ar-OH + N_2 + HX \qquad (A)$$

wherein X is the anion of the diazonium salt and Ar is an aromatic radical such as phenyl, substituted phenyl, naphthyl, substituted naphthyl and the like, and b. a spiropyran which is photochemically decomposable (as used herein, decomposable includes both chemical degradation and/or chemical rearrangement) into merocyanine.

The photochemical decomposition of the spiropyran results from the opening of the spiropyran ring under the action of ultraviolet radiation according to the reversible reaction:

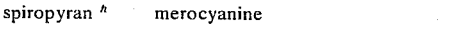

$$\text{spiropyran} \xrightarrow{h} \text{merocyanine} \qquad (B)$$

The transformation of the merocyanine to the spiropyran results from exposure to visible light.

The spiropyran compounds which are particularly suitable for use in the compositions and processes of the present invention are (I) indolyl-2-spiro(benzo-1-pyrane) and (II) benzothiazole-2-spiro(benzo-1-pyrane), of the following general formulas:

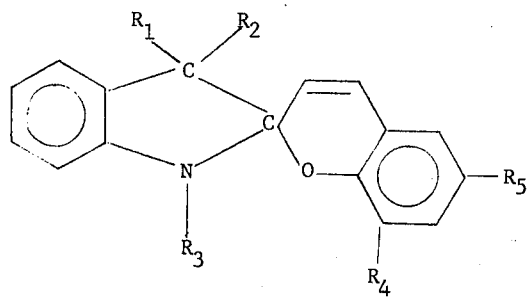

(I)

wherein $R_1$ is selected from the group consisting of lower alkyl;

$R_2$ is selected from the group consisting of lower alkyl;

$R_3$ is selected from the group consisting of lower alkyl and phenyl;

$R_4$ is selected from the group consisting of lower alkoxy, halogen, and hydrogen;

$R_5$ is selected from the group consisting of halogen and $NO_2$;

$R_6$ is selected from the group consisting of aliphatic hydrocarbons of from 1–17 carbon atoms, and wherein $R_{12}$ is selected from the group consisting of H and lower alkyl;

$R_7$ is selected from the group consisting of aliphatic hydrocarbons of from 1–17 carbon atoms; alicyclic hydrocarbons of from 5–8 carbon atoms

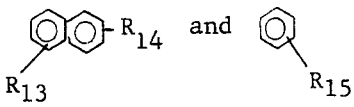

herein $R_{13}$, $R_{14}$ and $R_{15}$ may be the same or different and are each selected from the group consisting of H, S, Cl, Br, I, OH, $OCH_3$, $OC_2H_5$ and $OC_3H_7$;

$R_8$ is selected from the group consisting of H, O, S, S—$CH_3$, $NO_2$ and aliphatic hydrocarbons of 11 to 17 carbon atoms;

$R_9$ is selected from the group consisting of H, O, $OR_{16}$ wherein $R_{16}$ is selected from lower alkyl; and $OR_{17}$ wherein $R_{17}$ is selected from aliphatic hydrocarbons of 11 to 17 carbon atoms;

$R_{10}$ is selected from the group consisting of H and $OR_{18}$ wherein $R_{18}$ is selected from aliphatic hydrocarbons of 11 to 17 carbon atoms; and $R_{11}$ is $NO_2$.

Preferably, particularly when the photosensitive omposition includes low melting component (c);

$R_1$ and $R_2$ are each methyl;

$R_3$ is methyl or phenyl;

$R_4$ is methoxy, bromine or hydrogen;

$R_5$ is bromine or $NO_2$;

$R_6$ is alkyl of from 1 to 6 carbon atoms or

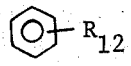

herein $R_2$ is methyl or ethyl;

$R_7$ is alkyl of from 1 to 6 carbon atoms, alicyclic hydrocarbons of from 5 to 8 carbon atoms; naphthyl or

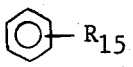

herein $R_{15}$ is H, S, Cl, Br, I, OH, $OCH_3$, $OC_2H_5$ or $OC_3H_7$;

$R_8$ is H, O, S—$CH_3$ or $NO_2$;

$R_9$ is H, O or $OCH_3$;

$R_{10}$ is hydrogen; and $R_{11}$ is $NO_2$.

Most perferably, for the benzothiazole-2-spiro-(benzo-1-pyrane) of Formula II, particularly when the photosensitive composition includes low melting component (c):

$R_6$ is methyl isopropyl, n-hexyl, benzyl and phenylethyl;

$R_7$ is $CH_3$, naphthyl, S-phenyl, phenyl,

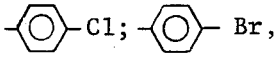

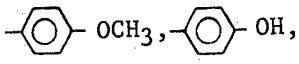

and cyclohexyl;

$R_8$ is H, O, and S-$CH_3$;

$R_9$ is O or $OCH_3$

However, when optional component (c) is omitted from the composition than at least one of $R_6$, $R_7$, and $R_8$ in the compound of formula (II) and $R_3$ or $R_4$ and either of $R_1$ or $R_2$ in formula (I) should preferably include a long chain hydrocarbon substituent, preferably an aliphatic hydrocarbon of from 11 to 17 carbon atoms and most preferablyh fro 13 to 17 carbon atoms; such that a spiropyran of a relatively low melting point will be obtained.

According to the embodiment of the present invention in which the normally solid, low melting component (c) is omitted from the photosensitive composition, it is preferred to use a relatively low melting merocyanine yielding spiropyran so that the lowest possible temperatures can be used in the photographic dry development process for dissolving and/or melting the phenol and merocyanine so that the colored merocyanine-phenol complex can form. Thus, in the absence of low melting component (c), it is preferred that $R_6$ and $R_7$ may be the same or different and are selected from alkyl of from one to four carbon atoms and aliphatic hydrocarbons of from 13 to 17 carbon atoms; $R_8$ is selected from hydrogen, $NO_2$ and aliphatic hydrocarbons of from 13 to 17 carbon atoms, with the proviso that at least one but not all of $R_6$, $R_7$ and $R_8$ are aliphatic hydrocarbons of from 13 to 17 carbon atoms; $R_9$ is selected from aliphatic hydrocarbons of 13 to 17 carbon atoms; and $R_{10}$ is hydrogen or $OR_{18}$ wherein $R_{18}$ is selected from aliphatic hydrocarbons of from 13 to 17 carbon atoms;

and most preferred that $R_6$ and $R_7$ are the same or different and are either $CH_3$ or $C_{16}H_{33}$; $R_8$ is hydrogen, $NO_2$ or $C_{16}H_{33}$; $R_9$ is hydrogen or $OC_{16}H_{33}$; and $R_{10}$ is hydrogen or $OC_{16}H_{33}$.

Methods for producing the benzothiazole spiro (benzopyran) compounds of formula II are described in : R. Guglielmetti and J. Metzger, Bull. Soc. Chim. Fr. 8, 2824 (1967) and British Patents No. 887 902 and 889 902.

Specific examples of preferred compounds of formula (I) and (II) include;

Formula I

| | $R_1$ | $R_2$ | $R_3$ | $R_4$ | $R_5$ |
|---|---|---|---|---|---|
| 1. | $CH_3$ | $CH_3$ | $C_6H_5$ | $OCH_3$ | $NO_2$ |
| 2. | $CH_3$ | $CH_3$ | $CH_3$ | Br | Br |
| 3. | $CH_3$ | $CH_3$ | $CH_3$ | H | $NO_2$ |

Formula II

| | $R_6$ | $R_7$ | $R_8$ | $R_9$ | $R_{10}$ | $R_{11}$ |
|---|---|---|---|---|---|---|
| 4. | $CH_3$ | $CH_3$ | H | $OCH_3$ | H | $NO_2$ |
| 5. | $CH_3$ | 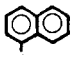 | H | $OCH_3$ | H | $NO_2$ |
| 6. | $CH_3$ | $CH_3$ | H | $OCH_3$ | H | $NO_2$ |
| 7. | $CH_3$ | $-S-C_6H_5$ | H | $OCH_3$ | H | $NO_2$ |
| 8. | $CH_3$ | $-C_6H_5$ | H | $OCH_3$ | H | $NO_2$ |
| 9. | $CH_3$ | 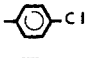 | H | $OCH_3$ | H | $NO_2$ |
| 10. | $CH_3$ | 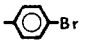 | H | $OCH_3$ | H | $NO_2$ |
| 11. | $CH_3$ | 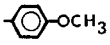 | H | $OCH_3$ | H | $NO_2$ |
| 12. | $CH_3$ | 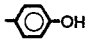 | H | $OCH_3$ | H | $NO_2$ |
| 13. | $CH_3$ | $CH_3$ | O | O | H | $NO_2$ |
| 14. | $CH_3$ | $CH_3$ | O | $OCH_3$ | H | $NO_2$ |
| 15. | $CH_3$ | $CH_3$ | $S-CH_3$ | O | H | $NO_2$ |
| 16. | $CH_3$ | $CH_3$ | $S-CH_3$ | $OCH_3$ | H | $NO_2$ |
| 17. | isopropyl | $CH_3$ | O | $OCH_3$ | H | $NO_2$ |
| 18. | n-hexyl | $CH_3$ | O | $OCH_3$ | H | $NO_2$ |
| 19. | benzyl | $CH_3$ | O | $OCH_3$ | H | $NO_2$ |
| 20. | phenylethyl | $CH_3$ | O | $OCH_3$ | H | $NO_2$ |
| 21. | $CH_3$ | napthyl | O | $OCH_3$ | H | $NO_2$ |
| 22. | $CH_3$ | cyclohexyl | O | $OCH_3$ | H | $NO_2$ |
| 23. | $CH_3$ | S-phenyl | O | $OCH_3$ | H | $NO_2$ |
| 24. | $CH_3$ | phenyl | O | $OCH_3$ | H | $NO_2$ |
| 25. | $CH_3$ | chloro-4-phenyl | O | $OCH_3$ | H | $NO_2$ |
| 26. | $CH_3$ | bromo-4-phenyl | O | $OCH_3$ | H | $NO_2$ |
| 27. | $CH_3$ | methoxy-4-phenyl | O | $OCH_3$ | H | $NO_2$ |
| 28. | $CH_3$ | hydroxy-4-phenyl | O | $OCH_3$ | H | $NO_2$ |

Other spiropyrans which will decompose into merocyanine when subjected to ultraviolet radiation are also perfectly suitable for use in the present invention. Indoline spiropyrans of the type described in Swiss Pat. No. 444,197 and 406,257 are particularly worthy of mention.

Since the merocyanine from the photochemical decomposition of the spiropyran will not react with the phenol from the photochemical decomposition of the diazonium salt to form a colored complex when these compounds are in the solid state, it is necessary to either melt or dissolve these compounds prior to the complexing reaction. This can be accomplished by heating the photosensitive composition after exposure to actinic radiation until the phenol and the merocyanine have both dissolved or melted. Preferably, where either the phenol or merocyanine has a relatively low melting point, the reactant having the lower melting point will act as a solvent for the other reactant during the heating stage.

However, since, in general, most phenols which can be produced by photochemical decomposition of diazonium salts have relatively high melting points, i.e. greater than about 100°C, it is preferred to use a spiropyran which will yield a merocyanine having a relatively low melting point, i.e. less than about 100°C, such as those described below.

As another alternative, a normally solid, low melting material can be incorporated in the photosensitive composition with the diazonium salt and the spiropyran. The material selected should be capable of dissolving both phenol compounds and merocyanine compounds while not interfering with the complexing reaction.

Spiropyrans having relatively low melting points (less than about 100°C) and which yield merocyanines having correspondingly low melting points include those with long-chain substituents in either of the ring compounds. While the long chain substituents may be straight or branched, saturated, unsaturated, substituted or unsubstituted, straight chain saturated hydrocarbons of from 11 to 17 carbon atoms are preferred; and 13 to 17 carbon atoms are more preferred, with 15 or 16 carbon atoms most preferred.

Benzothiazole-2-spiro(benzo-1-pyrane) of formula II above with the following substituents are representative of spiropyrans yieldng low melting point merocyanines:

| | $R_6$ | $R_7$ | $R_8$ | $R_9$ | $R_{10}$ | $R_{11}$ | melting point °C |
|---|---|---|---|---|---|---|---|
| 29. | $CH_3$ | $C_{16}H_{33}$ | H | $OCH_3$ | H | $NO_2$ | 89 |
| 30. | $CH_3$ | $C_{16}H_{33}$ | H | H | H | $NO_2$ | 84 |
| 31. | $C_{16}H_{33}$ | $CH_3$ | H | $OCH_3$ | H | $NO_2$ | 78 |
| 32. | $CH_3$ | $CH_3$ | $C_{16}H_{33}$ | $OCH_3$ | H | $NO_2$ | 84 |
| 33. | $CH_3$ | $C_{16}H_{33}$ | $NO_2$ | $OCH_3$ | H | $NO_2$ | 97 |
| 34. | $C_{16}H_{33}$ | $C_{16}H_{33}$ | H | $OCH_3$ | H | $NO_2$ | 61 |
| 35. | $C_{16}H_{33}$ | $CH_3$ | H | H | $OC_{16}H_{33}$ | H | 44 |
| 36. | $C_{16}H_{33}$ | $C_{16}H_{33}$ | H | $OC_{16}H_{33}$ | H | H | 41 |
| 37. | $C_{16}H_{33}$ | $CH_3$ | $C_{16}H_{33}$ | H | $OC_{16}H_{33}$ | H | 56 |

The following diazonium salts are cited as representative examples of the wide variety of diazonium salts which yield phenol when subjected to ultraviolet radiation and which can be used in the novel photosensitive compositions and processes of the present invention:

--chlorozincates and fluroborates (or other salts) of:
p-diazodiethylaniline
diazodiethyl-p-phenylene diamine
diazodibenzyl-p-phenylene diamine
diazo-p-aminodiphenylamine
p-morphalinobenzene diazonium
diazo-p-N-β-hydroxyethyl-N-methyl aminobenzene
diazo-p-dihydroxypropylaminobenzene
diazo-p-diamylaminobenzene
p-diazophenylmorpholine
N-(4-diazo-2,5-diethoxyphenyl)morpholine Also suitable for use are p-phenylene-diamine-N,N-substituted compounds of the general formula:

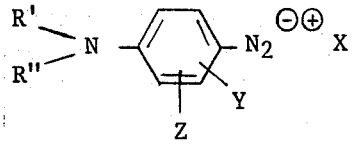

(III)

wherein

X stands for an anion, R′ and R″ each are aliphatic groups, and Z and Y denote groups which can be introduced into the benzene nucleus;

aminodiphenyl compounds, aminodiphenyl amine compounds and their analogues of the following general formula:

$$X^{-+}N_2 - R''' - A - R^{iv} \qquad (IV)$$

wherein

X is an anion, R‴ is a divalent aryl group, $R^{iv}$ is a mono-or divalent aryl or alkyl group, A is a divalent group or a direct bond and examples of the R‴ —A—$R^{iv}$ are diarylamine (A;—NH—), diphenyl (A; direct bond), diphenyl oxide (A;—O—), diaryl methane (A;—$CH_2$—), stilbene (A;—CH=CH—) and diaryl or dialkyl sulfide (A;—S—);

heterocyclic amine derivatives of the following general formula:

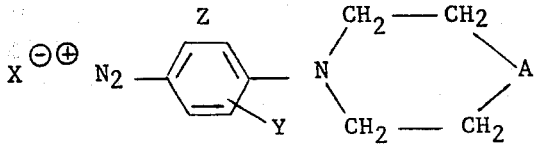

(V)

wherein X stands for an anion, Y and Z are groups which can be introduced into the benzene nucleus, and A is a direct bond or a divalent group such as —O—, —S— and methylene; and N,N-substituted ortho-phenylene diamine derivatives and orthoamino-phenol derivatives such as 2-diazo-4-methylmercapto-N,N′-dimethyl aniline and 2-diazo-5-benzoylamino-N,N′-dimethyl aniline Examples of compounds of formula (III) include;

4-diazo-N,N-dimethyl aniline
4-diazo-N,N-diethyl aniline
4-diazo-N-ethyl-N-β-hydroxyethyl aniline
4-diazo-N,N-bis-β-hydroxyethyl aniline
4-diazo-N-ethyl-N-(β-diethylamino)-ethyl aniline
4-diazo-N-ethyl-N-benzyl aniline Examples of compounds of formula (IV) include;

para-diazophenyl amine
4-diazo-2,5,4′-triethoxydiphenyl amine
4-diazo-2,5,4′-triethoxyphenyl Examples of compounds of formula (V) include:

4-diazo-2,5-dibutoxy-N-phenylmorpholine
4-diazo-N-phenyl piperidine
4-diazo-N-phenyl pyrrolidone As previously noted, the photosensitive compositions of the present invention may include a normally solid material having a low melting point, i.e. lower than about 150°C, preferably in the range of from about 60°C to about 120°C and most preferably from about 60°C to about 100°C. The role of this material is to melt at the heating stage of the dry development process of the present invention and to dissolve at least partially, and preferably, fairly completely the phenol and merocyanine produced in the previous stages of the process of the invention to permit the complexing reaction of the phenol and merocyanine.

Any material which satisfies the above parameters (e.g. melting point; solvent for phenol and merocyanine) and which will not interfere with the complexing reaction can be used in this invention. Examples of suitable normally solid, low melting materials include: esters of fatty acids such as ethylene glycol monostearate; waxes such as paraffin wax, beeswax, Carnauba wax; spermaceti; calcium salts of stearate, palmitate, myristate, laurate, behenate, arachinate, caprinate, pelargonate, caprylate, heptoate, caproate, versatate, nonate, oleate, ricinoleate and naphthanate; barium salts of stearate, palmitate, laurate, behenate, arachinate, caprinate, pelargonate, caprylate, versatate, nonate, octoate, oleate, ricinoleate and naphthanate; strontium salts of stearate, laurate, arachinate, oleate, naphthenate, adipate and sebacate; sodium salt of stearate, palmitate, laurate, myristate, caprinate, pelargonate, caprylate, heptoate, capronate, versatate, octoate, undecylenate, oleate, lineolate and ricinoleate.

The compositions of the present invention can be prepared by any suitable means. For example, solutions of each of the components in volatile solvents, such as water, methanol, ethanol, acetone, methyl ethyl ketone, ethyl acetate, ethylene glycol monomethyl ether and the like, can be prepared and mixed with each other. Likewise, it is also possible to mix each of the components in dry form, e.g. finely divided powder, and then apply the composition in solution form or otherwise to any suitable base layer. Suitable base layers for the photosensitive compositions of the present invention include transparent paper; varnished films, such as cellulose acetate or cellulose triacetate; polyesters such as polyethylene terephthalate; plastic films coated with a matting layer; and, in general, any suitable heliograhic paper material.

The compositions can be applied to the base layer by any standard means, such as, for example, spraying, rollers, scrapers, and the like. The photosensitive composition is applied as a thin layer to the base layer and allowed to dry. Preferably the photosensitive layer, as an emulsion, is coated on the base layer to present about 5 to about 50g/m$^2$ and preferably about 15 to 35g/m$^2$.

In addition to the diazonium salt, spiropyran and normally solid, low melting material, if used, the photosensitive compositions of the present invention may also contain additional ingredients such as a binder to give plasticity to the composition; an agent to facilitate the complexing reaction; an agent such as surfactants to improve the adhesion of the composition on the base layer; wetting agents to facilitate application to the base layer; humectants and the like.

Examples of suitable binder materials include, for example, polyvinyl-pyrollidone, polyvinyl alcohol, carboxymethyl cellulose, methyl cellulose, hydroxyethyl cellulose, etc. For certain of the suitable binder materials, such as polyvinylpyrollidone, the binder can also serve as the normally solid, low melting material in the photosensitive composition.

Materials which facilitate the complexing reaction, include, for example, urea, thiourea, zinc chloride, stannous chloride, and sodium cobaltnitride. It is noted that in addition to its complexing activity (formation of chelates) zinc chloride also acts as a stabilizer because of its acidity. Other stabilizing substances which can be used include acids, such as citric acid, tartaric acid, boric acid, acetic acid, phosphoric acid, succinic acid, benzoic acid, benzene sulfonic acid, naphthalene trisulfonic acid, sulfosalicylic acid, etc.; alum and aluminum sulfate, etc.

Materials which aid in the adhesion of the photosensitive composition to the base layer include, for example, saponin, Tergitol NPX (a product of Carbind and Carbon Chemicals Co.), Igepal CA-630 (iso-octyl, non-ionic liquid, a product of American Cyanamid Co.), Armac (acetate salts of aliphatic, primary, secondary and tertiary amines, a product of Armour & Co.), and other wetting agents such as sulfates and sulfonates, e.g. lauryl-sulfate, alkyl benzene sulfonate, etc.

Suitable humectants include, for example, glycols or glycerin.

In preparing the photosensitive compositions of the present invention, the diazonium salt and spiropyran should be present in molar ratios of diazonium salt to spiropyran varying from 0.7 – 2.6:1 and preferably from about 1.7:1. Most preferably the diazonium salts and spiropyran will be present in approximately stiochiometric amounts since the presence of a notable excess over the stoichiometric requirements of either of the above reagents could involve drawbacks. Thus, particularly when there is a stoichiometric excess of spiropyran, the spiropyran remaining after transformation to merocyanine is capable of developing a coloring independent of that resulting from the formation of the merocyanine-phenol complex.

The low melting normally solid material can be present in the photosensitive composition from 0 percent to about 65 percent by weight based on the total composition, and preferably from about 0.2 to about 12 percent by weight.

The photosensitive compositions of the present invention can be used for preparing reproductions of original transparencies containing image areas and non-image transparent areas as positives or negatives thereof and in colors ranging from blue-black, blue, green, red, orange, brown and colors in between, the only limitation being on proper selection of the proper diazonium salts and spiropyrans, such selection being well within the skill of the ordinary practitioner and not requiring any undue experimentation.

After a layer of the photosensitive composition containing a homogeneous mixture of i. at least one diazonium salt photodecomposable into a phenol compound;

ii. at least one spiropyran photodecomposable into a merocyanine compound; and optionally iii. a normally solid material having a melting point lower than about 150°C and which is a solvent for both the phenol and the merocyanine when in the molten state is coated on a suitable base layer a negative image of the original can be obtained according to the process of the present invention by a. placing the original over the photosensitive composition; and b. subjecting the photosensitive layer to imagewise exposure of actinic radiation whose emission spectrum encompasses the absorption bands of the diazonium salt(s) and of the spiropyran compound(s) to thereby produced phenol and merocyanine in the exposed areas;

c. heating the photosensitive layer until both the phenol and merocyanine are substantially completely in reactive state, i.e. dissolved or melted;

d. allowing the formation of a colored complex of merocyanine-phenol in the exposed areas to thereby form the negative image of the original.

When a positive image is to be formed from the original, the reversibility of the reaction (B)

$$\text{spiropyran } h_2 \quad \text{merocyanine} \qquad (B)$$

is taken advantage of by a. subjecting the photosensitive layer carried on a suitable base layer to actinic radiation whose emission spectrum encompasses both the absorption band of the diazonium salt and of the spiropyran to thereby produce phenol and merocyanine.
b. after exposure, the original is placed over the exposed photosensitive layer and
c. the photosensitive layer is subjected to imagewise exposure of actinic radiation including the visible range which encompasses the absorption band of the merocyanine to thereby reconvert the merocyanine to the spiropyran in the re-exposed areas.

Then, the photosensitive layer is heated to melt or dissolve the phenol and the subsisting merocyanine to allow the formation of the colored complex of merocyanine-phenol in the areas which have not been re-exposed (which correspond to the image areas of the original) and thereby produce a positive image of the original.

Depending on the particular selection of the diazonium salt and spiropyran compound the temperature during the complexing reaction should be between about 80°– 180°C. The reaction goes to completion within a very short time, generally within the range of 1/10 to 1 second. In order to prevent premature reaction between the phenol and merocyanine, the exposure of the photosensitive layer is usually and preferably conducted at room temperature.

Figure 2:
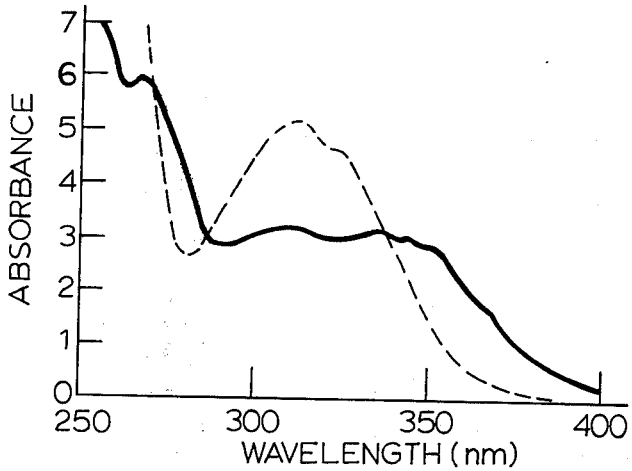

The source of the actinic radiation is not critical so long as the emission spectrum encompasses the absorption bands of the respective diazonium salts and spiropyrans. This will generally require use of an ultraviolet light source, i.e. wavelengths of from 185 – 380 mμ. Absorption spectra for several diazonium salts and spiropyrans are shown in FIGS. 1 and 2.

The following examples illustrate the preparation of photosensitive compositions according to the present invention. The examples are, of course, merely illustrative of the compositions of the present invention and are not intended as limitations thereof.

EXAMPLE 1

A solution A is prepared as follows:

| Solution A | |
|---|---|
| Water | 150cc |
| p-diazophenyl-morpholine fluoroborate | 5g |
| Thiourea | 7.5g |
| $ZnCl_2$ | 15g |
| Saponin | 0.25g |

A solution A is then combined with a solution of the spiropyran compound: Solution B

| Solution B | |
|---|---|
| Solution A | 10cc |
| spiropyran of Formula II ($R_6$=$CH_3$, $R_7$=$C_{10}H_{33}$, $R_8$ H, $R_9$=H, $R_{10}$=H, $R_{11}$=$NO_2$) | 350mg |
| Polyvinylpyrollidone in solution at 7.5% by weight in ethanol | 20cc |

Solution B is then applied as a coating by rollers, sprayers, etc. on a suitable base layer at a rate of 25g/m².

This photosensitive composition will form a red colored complex when used in the photographic process of the present invention.

EXAMPLE 2

Example 1 is repeated except that in place of the benzothiazole spiropyran, an indoline spiropyran of Formula I is used in which $R_1$=$R_2$=$R_3$=$CH_3$ and $R_4$=$R_5$=Br.

A colored complex is formed with a blue-green color.

EXAMPLE 3

Example 1 is repeated except that in place of p-diazophenyl-morpholine thiaborate, p-diazodiethyl aniline is employed.

A green colored complex is formed.

EXAMPLE 4

A diazonium salt solution is prepared as follows:

| Solution A | |
|---|---|
| Water | 150cc |
| N-(4-diazo-2,5-diethoxyphenyl)morpholine chlorozincate | 5g |
| Thiourea | 37.5g |
| $ZnCl_2$ | 15g |
| Saponin | 0.25g |

Then, Solution A is mixed with a solution of a spiropyran:

| Solution B | |
|---|---|
| Spiropyran of Formula II ($R_6$=$R_7$=$CH_3$, $R_8$=$SCH_3$, $R_9$=$OCH_3$, $R_{10}$=H, $R_{11}$=$NO_2$) | 350mg |
| Polyvinylpyrollidone in solution at 7.5% by weight in ethanol | 20cc |
| Solution A | 10cc |

Solution B is coated on a suitable base layer at a rate of 25g/m². Solution B will form an orange colored complex.

EXAMPLE 5

Example 4 is repeated by replacing the benzothiazole spiropyran with an indoline spiropyran of Formula I ($R_1$=$CH_3$, $R_2$=$CH_3$, $R_3$=$C_6H_5$, $R_4$=$OCH_3$, $R_5$=$NO_2$)

A blue colored complex will be formed.

EXAMPLE 6

Example 4 is repeated except that 175mg of the spiropyran was replaced with 175mg of spiropyran of Formula II ($R_6$=$CH_3$, $R_7$=S-phenyl, $R_8$=H, $R_9$=$OCH_3$, $R_{10}$=H, $R_{11}$=$NO_2$)

A colored complex of brown is formed.

While the present invention has been primarily described by reference to the foregoing exemplification and description of the preferred embodiments, it should be understood that the present invention should in no way be limited thereto, but rather must be construed as broadly as all or any equivalents thereof.

What is claimed is:

1. A photographic process for dry developing a negative image of an original containing image areas and non-image transparent areas comprising a. placing said original over a photosensitive layer carried on a base layer, said photosensitive layer comprising a homogeneous mixture of
   i. at least one diazonium salt photodecomposable into phenol; and ii. at least one spiropyran compound photodecomposable into merocyanine, said spiropyran compounds selected from the group consisting of indolyl-2-spiro(benzo-1-pyrane) compounds and benzothiazole-2-spiro(benzo-1-pyrane) compounds wherein the molar ratio of said diazonium salt (i) to said spiropyran compound (ii) is from 0.7 –2.6:1; and iii. from 0–65 percent by weight, based on the total of (i), (ii) and (iii) of a normally solid material having a melting point lower than about 150°C and which when in the molten state is a solvent for said phenol and said merocyanine, b. subjecting said photosensitive layer to imagewise exposure of actinic radiation whose emission spectrum encompasses the absorption bands of both said at least one diazonium salt of (a) (i) and of said at least one spiropyran compound of (a) (ii) to thereby produce said phenol and said merocyanine in the exposed areas;

c. heating said photosensitive layer until both of said phenol and said merocyanine are substantially completely dissolved or melted; and d. allowing the formation of a colored complex of said phenol and said merocyanine in the exposed areas to thereby form a negative image of said original.

2. The photographic process of claim 1 wherein said spiropyran is selected from the group consisting of indolyl-2-spiro(benzo-1-pyrane) of the formula (I) wherein $R_1$ and $R_2$ are lower alkyl; $R_3$ is lower alkyl or phenyl; $R_4$ is lower alkoxy, halogen or hydrogen; and $R_5$ is halogen or $NO_2$ and benzothiazole-2-spiro-(benzo-1-pyrane) of the formula (II)

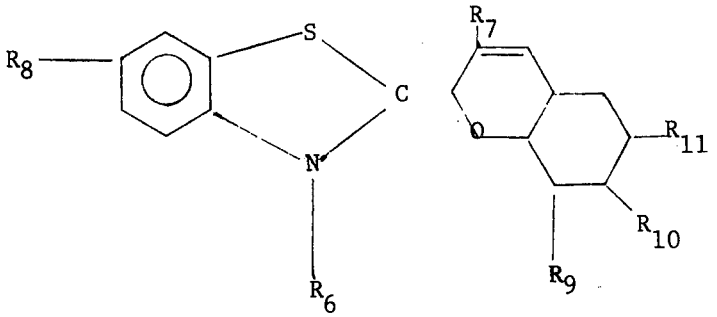

(II)

wherein $R_6$ is selected from the group consisting of aliphatic hydrocarbons of from 1-17 carbon atoms; and

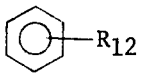

wherein $R_{12}$ is selected from the group consisting of H and lower alkyl;

$R_7$ is selected from the group consisting of aliphatic hydrocarbons of from 1-17 carbon atoms; alicyclic hydrocarbons of from 5-8 carbon atoms;

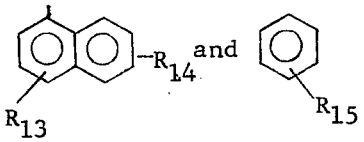

wherein $R_{13}$, $R_{14}$ and $R_{15}$ may be the same or different and are each selected from the group consisting of H, S, Cl, Br, I, OH, $OCH_3$, $OC_2H_5$, and $OC_3H_7$;

$R_8$ is selected from the group consisting of H, O, S, S—$CH_3$, $NO_2$ and aliphatic hydrocarbons of 11 to 17 carbon atoms;

$R_9$ is selected from the group consisting of H, O, $OR_{16}$ wherein $R_{16}$ is selected from lower alkyl; and $OR_{17}$ wherein $R_{17}$ is selected from aliphatic hydrocarbons of 11 to 17 carbon atoms;

$R_{10}$ is selected from the group consisting of H and $OR_{18}$ wherein $R_{18}$ is selected from aliphatic hydrocarbons of 11 to 17 carbon atoms; and $R_{11}$ is $NO_2$.

3. The photographic process of claim 2 wherein said diazonium salt is selected from the group consisting of salts of:

p-diazodiethylaniline
diazodiethyl-p-phenylene diamine
diazodibenzyl-p-phenylene diamine
diazo-p-aminodiphenylamine
p-morpholinobenzene diazonium
diazo-p-N-β-hydroxyethyl-N-methyl aminobenzene
diazo-p-dihydroxypropylaminobenzene
diazo-p-diamylaminobenzene
p-diazophenylmorpholine
N-(4-diazo-2,5-diethoxyphenyl)morpholine.

4. A photographic process for dry developing a positive image of an original containing image areas and non-image transparent areas comprising a. subjecting a photosensitive layer carried on a base layer, said photosensitive layer comprising a homogeneous mixture of i. at least one diazonium salt photodecomposable into phenol; and ii. at least one spiropyran compound photodecomposable into merocyanine, said spiropyran compounds selected from the group consisting of indolyl-2-spiro(benzo-1-pyran) compounds and benzothiazole-2-spiro(benzo-1-pyrane)compounds wherein the molar ratio of said diazonium salt (i) to said spiropyran compound (ii) is from 0.7-2.6:1; and iii. from 0–65 percent by weight, based on the total of (i), (ii), and (iii) of a normally solid material having a melting point lower than about 150°C and which when in the molten state is a solvent for said phenol and said merocyanine; to actinic radiation whose emission spectrum encompasses both the absorption band of said at least one diazonium salt of (i) and of said at least one spiropyran compound of (ii) to thereby produce said phenol and said merocyanine;

b. placing said original over said exposed photosensitive layer;

c. subjecting said photosensitive layer to image-wise exposure of actinic radiation whose emission spectrum encompasses the absorption band of said merocyanine to thereby reconvert said merocyanine to said spiropyran in said re-exposed areas;

d. heating said photosensitive layer until both of said phenol and said merocyanine are completely melted or dissolved; and e. allowing the formation of a colored complex of said phenol and said merocyanine in the areas corresponding to the image areas of the original to thereby form a positive image of said original.

5. The photographic process of claim 4 wherein said spiropyran is selected from the group consisting of indolyl-2-spiro(benzo-1-pyrane) of the formula (I)

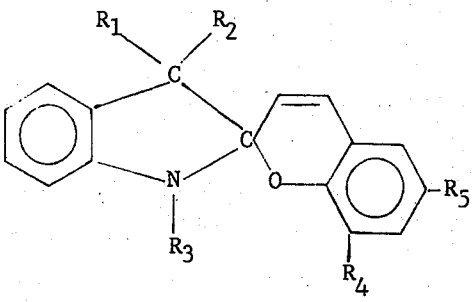

(I)

wherein $R_1$ and $R_2$ are lower alkyl; $R_3$ is lower alkyl or phenyl; $R_4$ is lower alkoxy, halogen or hydrogen; and $R_5$ is halogen or $NO_2$; and benzothiazole-2-spiro(benzo-1-pyrane) of the formula (II)

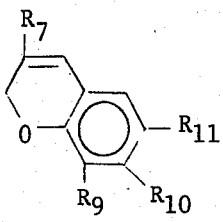

(II)

wherein $R_6$ is selected from the group consisting of aliphatic hydrocarbons of from 1-17 carbon atoms; and

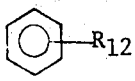

wherein $R_{12}$ is selected from the group consisting of H and lower alkyl;

$R_7$ is selected from the group consisting of aliphatic hydrocarbons of from 1-17 carbon atoms; alicyclic hydrocarbons of from 5-8 carbon atoms;

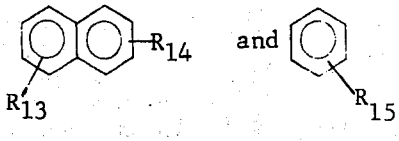

wherein $R_{13}$, $R_{14}$ and $R_{15}$ may be the same or different and are each selected from the group consisting of H, S, Cl, Br, I, OH, $OCH_3$, $OC_2H_5$, and $OC_3H_7$;

$R_8$ is selected from the group consisting of H, O, S, S—$CH_3$, $NO_2$ and aliphatic hydrocarbons of 11 to 17 carbon atoms;

$R_9$ is selected from the group consisting of H, O, $OR_{16}$ wherein $R_{16}$ is selected from lower alkyl; and $OR_{17}$ wherein $R_{17}$ is selected from aliphatic hydrocarbons of 11 to 17 carbon atoms;

$R_{10}$ is selected from the group consisting of H and $OR_{18}$ wherein $R_{18}$ is selected from aliphatic hydrocarbons of 11 to 17 carbon atoms; and $R_{11}$ is $NO_2$.

6. The photographic process of claim 5 wherein said diazonium salt is selected from the group consisting of salts of:

p-diazodiethylaniline
diazodiethyl-p-phenylene diamine
diazodibenzyl-p-phenylene diamine
diazo-p-aminodiphenylamine
p-morpholinobenzene diazonium
diazo-p-N-β-hydroxyethyl-N-methyl aminobenzene
diazo-p-dihydroxypropylaminobenzene
diazo-p-diamylaminobenzene
p-diazophenylmorpholine, and
N-(4-diazo-2,5-diethoxyphenyl)morpholine.

7. The photographic process of claim 2 which includes said normally solid material (iii) and wherein $R_1$ and $R_2$ are each methyl;
$R_3$ is methyl or phenyl;
$R_4$ is methoxy, bromine or hydrogen;
$R_5$ is bromine or $NO_2$
$R_6$ is alkyl of from 1 to 6 carbon atoms or

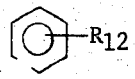

wherein $R_{12}$ is methyl or ethyl;

$R_7$ is alkyl of from 1 to 6 carbon atoms, alicyclic hydrocarbons of from 5 to 8 carbon atoms; naphthyl or

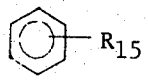

wherein $R_{15}$ is H, S, Cl, Br, I, OH, $OCH_3$, $OC_2H_5$ or $OC_3H_7$;

$R_8$ is H, O, S—$CH_3$ or $NO_2$; $R_9$ is H, O, or $OCH_3$;

$R_{10}$ is hydrogen; and $R_{11}$ is $NO_2$.

8. The photographic process of claim 2 which does not include said normally solid material (iii) and wherein at least one of $R_6$, $R_7$ and $R_8$ in the compound of formula (II) and $R_3$ or $R_4$ and either of $R_1$ and $R_2$ in formula (I) is an aliphatic hydrocarbon of from 11 to 17 carbon atoms.

9. The photographic process of claim 2 which does not include said normally solid, low melting compound (iii) and wherein said spiropyran is selected from benzothiazole-2-spiro(benzo-1-pyrane) of formula (II) wherein $R_6$ and $R_7$ may be the same or different and are selected from alkyl of from one to four carbon atoms and aliphatic hydrocarbons of from 13 to 17 carbon atoms; $R_8$ is selected from hydrogen, $NO_2$ and aliphatic hydrocarbons of from 13 to 17 carbon atoms, with the proviso that at least one but not all of $R_6$, $R_7$ and $R_8$ are aliphatic hydrocarbons of from 13 to 17 carbon atoms; and $R_{10}$ is hydrogen or $OR_{18}$ wherein $R_{18}$ is selected from aliphatic hydrocarbons of from 13 to 17 carbon atoms;

* * * * *

UNITED STATES PATENT AND TRADEMARK OFFICE

CERTIFICATE OF CORRECTION

PATENT NO. : 3,964,911

DATED : June 22, 1976

INVENTOR(S) : Jean Jules Robillard

It is certified that error appears in the above-identified patent and that said Letters Patent are hereby corrected as shown below:

Item 30, line 2, delete "72.27090", insert -- 72.45972 --

Claim 2, line 3, beneath line 3 insert the following formula (I):

-- 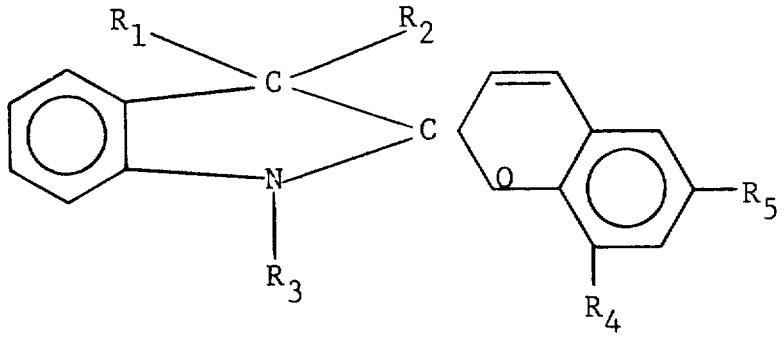 (I) --

Claim 3, line 12, after "p-diazophenylmorpholine" insert -- , and --

Claim 5, delete formula (II) and insert the following therefor:

-- 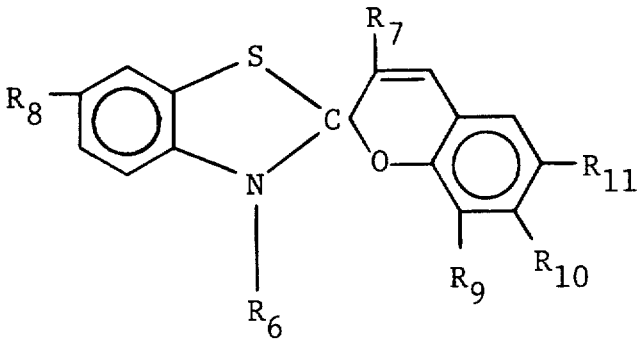 (II) --

UNITED STATES PATENT AND TRADEMARK OFFICE

CERTIFICATE OF CORRECTION

PATENT NO. : 3,964,911

DATED : June 22, 1976

INVENTOR(S) : Jean Jules Robillard

It is certified that error appears in the above-identified patent and that said Letters Patent are hereby corrected as shown below:

Claim 9, line 13, after ";" insert -- $R_9$ is selected from aliphatic hydrocarbons of 13 to 17 carbon atoms; --

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*